US005836498A

United States Patent [19]

Turek

[11] Patent Number: 5,836,498

[45] **Date of Patent: *Nov. 17, 1998**

[54] LOTTERY TICKET DISPENSER

[75] Inventor: Edmund F. Turek, Cincinnati, Ohio

[73] Assignee: Interlott Technologies, Inc., Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 628,994

[22] Filed: Apr. 10, 1996

[51] Int. Cl.[6] ..... B26F 3/02; B65H 35/10

[52] U.S. Cl. ..... 225/1; 225/2; 225/100; 225/103; 225/106

[58] Field of Search ..... 225/4, 5, 32, 100, 225/103, 104, 105, 106, 96.5, 1, 2; 400/621

[56] References Cited

U.S. PATENT DOCUMENTS

| | | | |
|---|---|---|---|
| 3,135,446 | 6/1964 | Sargent . | |
| 3,894,669 | 7/1975 | Wescoat | 225/103 |
| 4,094,451 | 6/1978 | Wescoat . | |
| 4,140,259 | 2/1979 | Kostka et al. . | |
| 4,261,497 | 4/1981 | Roetter et al. . | |
| 4,375,189 | 3/1983 | Berner et al. . | |
| 4,454,973 | 6/1984 | Irvine . | |
| 4,529,114 | 7/1985 | Casper et al. . | |
| 4,616,773 | 10/1986 | Kerivan | 225/100 X |
| 4,618,085 | 10/1986 | Kimura et al. . | |
| 4,623,081 | 11/1986 | Hain et al. . | |
| 4,697,726 | 10/1987 | Gaucher . | |
| 4,940,347 | 7/1990 | Lund | 225/100 X |
| 4,982,337 | 1/1991 | Burr et al. . | |
| 5,060,838 | 10/1991 | Gregely, Jr. . | |
| 5,133,615 | 7/1992 | Saito et al. . | |
| 5,141,142 | 8/1992 | Ramsey . | |
| 5,215,383 | 6/1993 | Hilton . | |

*Primary Examiner*—Eugenia A. Jones
*Attorney, Agent, or Firm*—Wood, Herron & Evans, L.L.P.

[57] ABSTRACT

An improved lottery ticket dispenser includes a burster wheel having a cylindrical contact surface. The improved burster wheel provides for an increased range of operation so that greater misalignment between the perforation or line of weakness between adjacent tickets in a fanfold stream and the path of the burster wheel can be accommodated while still providing a reliable and effective separation of the adjacent tickets along the line of weakness.

20 Claims, 1 Drawing Sheet

LOTTERY TICKET DISPENSER

BACKGROUND OF THE INVENTION

This invention relates generally to ticket dispensing systems and more particularly to an improved system and method for dispensing lottery tickets.

State sponsored lotteries are now a popular and accepted method of generating revenue and providing entertainment. One popular form of lottery uses an instant lottery ticket on which winning or non-winning combinations are pre-printed before distribution and the player knows immediately after purchasing the ticket whether or not it is a winning ticket. A common system for distributing instant lottery tickets includes a large number of ticket dispensing machines located at drug stores, supermarkets, convenient stores and the like. Common concerns associated with such lottery ticket dispensing machines are the speed with which they dispense the tickets, the security or anti-theft characteristics of the dispenser and the ability to accurately provide an accounting for the tickets sold from each machine.

Due to the popularity of the instant lottery ticket games and the advantage of minimizing clerical involvement with the purchasing and dispensing of instant lottery tickets, it is common for a large number of tickets to be stored within the dispensing machine. Presently, tickets are commonly stored in a fanfold form so that they may be rapidly fed out from a storage compartment without the risk of unintentionally dispensing too many tickets as is common when individual tickets are stored and dispensed from the machine. However, the fanfold tickets must be separated by the machine prior to being dispensed. The mechanism to separate the fanfold tickets from one another should ensure that the separation of the tickets occurs only at the joinder line between the tickets despite whatever variations in the size of tickets and slippage or inaccuracy in the dispensing mechanism may be present.

A problem associated with the dispensing of lottery tickets stored in a fanfold stream is how to ensure that each ticket as it becomes the leading ticket will be separated from the next following ticket precisely along the joinder line between the tickets. In such a fanfold stream, a line of weakness such as a perforation line is provided to define each ticket and to permit fanfolding of the stream of connected tickets. Commonly, each fold contains a single ticket but in alternative embodiments, a number of tickets for example five or more may be provided within each fold. Lottery tickets conventionally are constructed from laminated layers of paper or cardboard and as such are relatively stiff and inflexible.

Prior art solutions to these problems include using a knife edge or cutting blade to slice through the stream of tickets. This is not desirable because the knife edge may cut through the tickets at any point such as in the middle of the ticket. Therefore, a highly precise alignment device usually must be provided with a knife edge to bring it into precise alignment with the joinder line between the tickets.

One particularly successful prior art solution to these problems is disclosed in U.S. Pat. No. 4,982,337 ("the '337 patent") which is assigned to the assignee of the present invention and hereby incorporated by reference. According to the '337 patent, the tickets are stored in a fanfold form and the individual tickets are burst, rather than cut, apart prior to dispensing. The separation mechanism of the '337 patent comprises a bursting wheel which separates the leading ticket from the next following ticket along the line of weakness therebetween instead of cutting the two tickets apart. The burster wheel inherently reduces the risk of producing only half a ticket. The burster wheel of the '337 patent is in the form of a circular burster blade which has a dull rounded edge that does not cut the stream of tickets but rather exerts pressure against the top of the stream of tickets to deflect the tickets and separate them along the line of weakness separating the tickets.

In order for the burster wheel of the '337 patent to effectively burst the leading ticket from the stream of tickets along the line of weakness, it must be sufficiently aligned with the lines of weakness and in close proximity thereto. Precise alignment between the rounded dull edge bursting blade and the line of weakness is important in that system.

However, the manufacturing tolerances of the tickets vary greatly. For example, the length of individual tickets with respect to other tickets in the same fanfold stream varies a relatively large amount and may be on the order of 1/16 inch or so. As a result, even though the burster wheel may be aligned with the majority of the lines of weakness in a given fanfold stream, due to the variations in the lengths of the tickets, it is commonly misaligned with other lines of weakness and thereby may provide an ineffective separation or fail to separate the tickets at all.

Similarly, the perforations or lines of weakness between the individual tickets are not uniformly formed such that a greater force may be required from the bursting wheel to separate one line of weakness than another line of weakness in the same fanfold stream. Tickets are manufactured with varying degrees of perforation quality. Some have tough perforations while some perforations are easily separated. It is widely recognized that perforation quality varies greatly due to a number of variables including, the ticket printing company, ticket stock, ticket coatings and the like. Aside from these variables, perforation quality can still vary within the same game with the same ticket press run. The consistency of ticket perforations vary not only from company to company but also from game to game provided by the same manufacturer.

Moreover, the added force required to burst a poorly formed line of weakness requires more precise alignment between the burster wheel and the line of weakness to effectuate a separation. Therefore, misalignment between the line of weakness and the path of the burster wheel is even more critical when the perforation is poorly formed.

Since it is not feasible to locate the perforation on every ticket pack or between every ticket within the pack on every different game, it is important to have a reliable separation mechanism for the dispensing unit which is not compromised by these variables.

SUMMARY OF THE INVENTION

It has therefore been a primary objective of this invention to provide an improved dispenser for lottery tickets.

Another objective of the invention is to provide an improved burster mechanism which can overcome variations in the nominal ticket size and perforation quality and still provide an effective, reliable and accurate separation of the tickets.

It has been a still further objective of the invention to provide such a burster mechanism which can be spaced from the perforation or line of weakness separating the lottery tickets and upon contact with the tickets still provide a consistent and reliable separation.

These and other objectives of the invention have been attained by an improved burster wheel for use in a lottery ticket dispenser. The improved burster wheel includes a generally cylindrical contact surface around the perimeter of the wheel as opposed to the rounded or semi-circular surface in prior burster wheels. The cylindrical contact surface intersects the stream of fanfold tickets and thereby separates the adjacent tickets along the line of weakness or perforation therebetween.

The improved burster wheel having a cylindrical contact surface allows for a more consistent separation of the tickets irrespective of the variation in the tickets, perforations and materials. Moreover, a consistent separation of the tickets at the perforation can be obtained even with a misalignment or a spacing between the path of the burster wheel and the perforation. Therefore, the effective range or margin of error upstream and downstream from the line of weakness or perforation is significantly greater with the improved burster wheel having a cylindrical contact surface than that of the prior art semi-circular burster wheel. The increased margin of error with respect to the alignment of the path of the burster wheel and the perforation produces a more reliable and consistent separation of the tickets irrespective of variations in the tickets.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
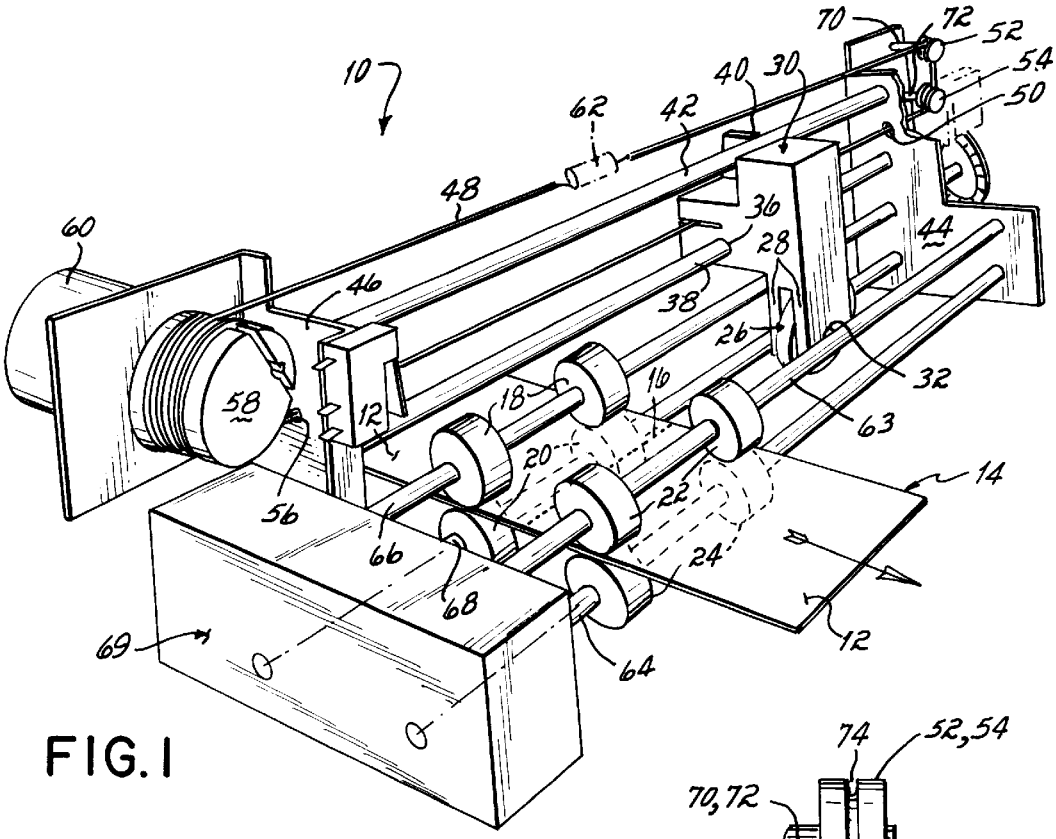
FIG. 1 is a perspective view of a presently preferred embodiment of a transport mechanism and burster assembly for feeding a stream of tickets and separating the adjacent tickets along a line of weakness within a dispensing unit.

A transport mechanism and burster assembly 10 is shown in FIG. 1 for a lottery ticket dispenser (not shown). A typical lottery ticket dispenser is shown in U.S. Pat. No. 4,982,337, the disclosure of which is hereby incorporated by reference. A plurality of individual tickets 12 are connected in a fanfold strip or stream 14. Individual tickets 12 are separated from an adjacent ticket by a line of weakness 16 which typically comprises perforations. The tickets 12 are provided typically by the state authority in a fanfold stack which is compact and easily transportable and typically include as many as 1,500 tickets in each stack. A stack of fanfold tickets 12 are contained in a storage compartment (not shown) in the lottery ticket dispenser. Each ticket 12 is connected to an adjacent ticket 12 along the line of weakness 16 and it will be understood that each successive following ticket 12 is separable from an adjacent ticket by a similar line of weakness 16.

The fanfold stream 14 of tickets 12 is fed along a dispensing path from the storage compartment toward an outlet (not shown). The stream 14 is transported along the dispensing path by the transport mechanism 10 including opposed upper feed rollers 18 and lower feed rollers 20 and opposed upper exit rollers 22 and lower exit rollers 24 as shown in FIG. 1.

A generally circular burster wheel 26 is mounted for rotation between spaced downwardly extending flanges 28 of a burster block 30. The burster wheel 26 is mounted for rotation on the burster block 30 on an axle 32 extending through cylindrical hubs 34 on each face of the burster wheel 26 and into the spaced flanges 28. The burster block 30 includes a bore hole 36 through which extends a lower burster bar 38. The burster block 30 also includes an upper cutout 40 which substantially surrounds an upper burster bar 42. The burster block 30 is mounted for a translation along the upper and lower burster bars 38, 42 between opposed side brackets 44, 46 of the transport mechanism 10.

A cable 48 extends from a first face of the burster block 30 through an aperture 50 in the side bracket 44 and around an upper idler roller 52 and a lower idler roller 54. The cable 48 also extends from an opposite face of the burster block 30 through an aperture 56 in the side bracket 46 and is wound around a driven roller 58 driven by a motor 60. The cable 48 preferably includes a tensioning spring 62.

Figure 2:
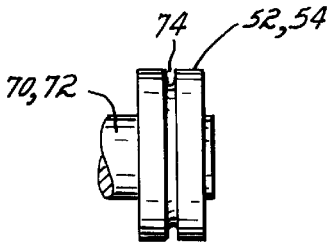
FIG. 2 is an enlarged plan view of the pulley wheel of the burster assembly of FIG. 1.

The idler rollers 52, 54 are each mounted on a post 70, 72, respectively, for rotation and include an arcuate cradle 74 in which the cable 48 contacts the roller 52, 54 (FIG. 2). The arcuate configuration of the cradle 74 minimizes stress concentration for the roller 52 or 54 and cable 48 interface and the likelihood that the cable 48 will bind or freeze up when passing over the roller 52 or 54. Furthermore, as shown in FIG. 1 the cable 48 passes over both the upper and lower idler rollers 52, 54 and contacts each roller in a 90° arc thereby minimizing the contact friction with each of the rollers 52, 54 and reducing the failure rate of the components.

The upper exit rollers 22 are journaled on a common upper exit shaft 63 and the lower exit rollers 24 are journaled similarly on a lower exit shaft 64. Likewise, the upper feed rollers 18 are journaled on a common upper feed shaft 66 and the lower feed rollers 20 are journaled on a common lower feed shaft 68. The shafts 62, 64, 66, 68 extend between the bracket 44 and a housing 69 containing a motor (not shown) for rotationally driving the shafts 63, 64, 66, 68 to advance the stream 14 of tickets 12. The motors and operation of the transport mechanism 10 are controlled by a control circuit (not shown) as is well known in the art. The transport mechanism 10 may include an aligning mechanism comprising a code wheel (not shown) or the like as is disclosed in the '337 patent.

When the burster block 30 and burster wheel 26 are moved from the rest position illustrated in FIG. 1 toward interception with the dispensing path of the stream 14 of tickets 12 through the action of the cable 48 and motor, the burster wheel 26 will come into contact with the stream 14 of tickets 12 at the side thereof initially then across the stream 14 of tickets 12 to burst the adjacent tickets 12 apart along the line of weakness 16. The burster block 30 is moved from right to left as shown in FIG. 1 to burst the leading ticket 12, then left to right to burst the next leading ticket 12, and so on.

The burster block 30 and wheel 26 translate along the bars to intersect the dispensing path of the stream 14 of tickets 12 perpendicularly. As a result, the path of the burster wheel 26 on the tickets 12 is generally parallel to the line of weakness 16 separating the adjacent tickets 12.

Figure 4:
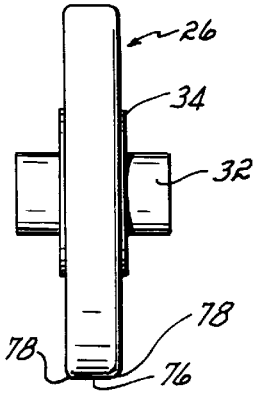
FIG. 4 is a view of a presently preferred embodiment of the burster wheel according to this invention.

The burster wheel 26 according to this invention includes a cylindrical contact surface 76 around the perimeter thereof as shown particularly in FIG. 4. In a presently preferred embodiment the overall outer diameter of the burster wheel 26 is 0.912 inches and the diameter of the central hubs 34 are 0.185 inches. The cylindrical contact surface 76 in a presently preferred embodiment is 0.187 inches wide and adjacent each edge of the cylindrical contact surface is a 0.062 inch radius 78. Preferably, the burster wheel 26 is fabricated from nylon or black acetal.

Figure 3:
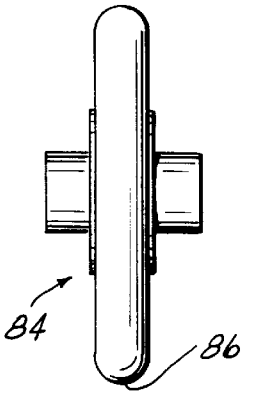
PRIOR ART FIG. 3
FIG. 3 is a view of the prior art burster wheel.
Figure 5:
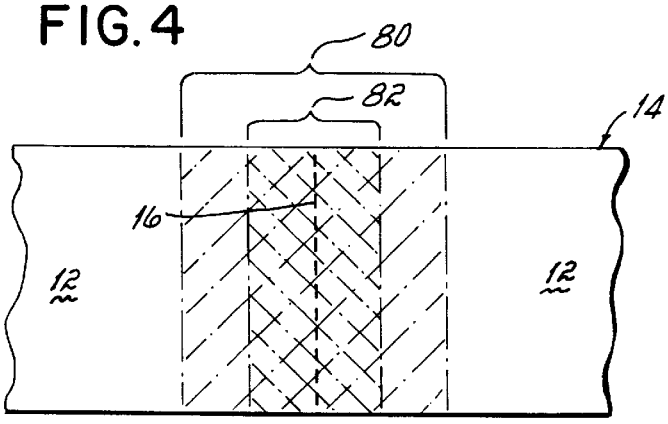
FIG. 5 is a top plan view of the line of weakness between a pair of adjacent tickets showing an increased range of effectiveness of the burster wheel of the present invention.

The improved burster wheel 26 of the present invention advantageously provides an increased effective separation range 80 in which the wheel contacts the stream 14 of tickets 12 and provides an effective separation of the tickets 12. The burster wheel 26 of this invention provides the larger effective range 80 as shown in FIG. 5 in which the wheel 26 may contact the stream 14 of tickets 12 and still separate the adjacent tickets 12 along the line of weakness 16 as compared to a range of operation 82 provided by a prior art burster wheel 84 (FIG. 3) having a rounded outer edge contact surface 86. Specifically, the effective range of the presently preferred embodiment of the burster wheel is a total of about ¼ of an inch or ⅛ of an inch on either side of the line of weakness 16 separating the adjacent tickets 12. In contrast, the prior art burster wheel of FIG. 3 having the rounded contact surface 86 provides only a ⅛ inch total effective range or a 1/16 of an inch on either side of the line of weakness 16. In other words, the separation distance from the line of weakness 16 within which the burster wheel 26 having a cylindrical contact surface 76 can intersect the dispensing path of the stream 14 of tickets 12 and still provide a reliable separation of the adjacent tickets 12 is doubled over the prior art rounded edge burster wheel 84.

As a result, variations in the alignment between the line of weakness 16 and the path of the burster wheel 26 due to the variations in the lengths of the tickets 12, the transport mechanism 10 variations or the like are significantly increased. Likewise, an incorrectly formed perforation 16 which requires greater downward force to deflect the tickets 12 and thereby burst the line of weakness 16 can be provided by the burster wheel 26 because the cylindrical contact surface 76 provides a larger effective range 80 of operation.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

I claim:

1. A bursting mechanism for separating individual, planar articles joined together along a line of weakness comprising:

a transport mechanism for feeding said articles along a dispensing path to an outlet, wherein said transport mechanism includes at least one roller mounted for rotation about a roller axis of rotation;

a bursting station located along said dispensing path; and a burster movably mounted for rotation about a burster axis of rotation to intersect said dispensing path proximate said line of weakness at said bursting station, said burster axis of rotation being generally perpendicular to said roller axis of rotation, said burster having a cylindrical contact surface which contacts said articles and separates a pair of adjacent articles along said line of weakness.

2. The bursting mechanism of claim 1 wherein the at least one roller of said transport mechanism further comprises:

at least one feed roller at said bursting station contacting said articles at a location along said dispensing path upstream of said line of weakness;

at least one discharge roller at said bursting station contacting said articles at a location along said dispensing path downstream of said line of weakness, said discharge and feed rollers each being rotationally driven and cooperating to hold said articles while said burster separates said pair of adjacent articles along said line of weakness.

3. The burster mechanism of claim 1 wherein said cylindrical contact surface on said burster extends completely around a circumference of said burster.

4. A lottery ticket dispenser comprising:

a transport mechanism for feeding a stream of lottery tickets along a dispensing path to an outlet, a pair of adjacent said tickets being separable from each other along a line of weakness therebetween, wherein said transport mechanism includes at least one roller mounted for rotation about a roller axis of rotation;

a bursting station located along said dispensing path; and a burster wheel mounted for rotation about a burster axis of rotation to roll over said stream of tickets at said bursting station and thereby separate said pair of adjacent tickets, said burster axis of rotation being generally perpendicular to said roller axis of rotation, said burster wheel having a cylindrical contact surface on a perimeter thereof which contacts said stream of tickets and separates said pair of adjacent tickets along said line of weakness.

5. The dispenser of claim 4 wherein said cylindrical contact surface on said burster wheel extends completely around a circumference of said burster wheel.

6. The dispenser of claim 4 wherein the at least one roller of said transport mechanism further comprises:

at least one feed roller at said bursting station contacting said lottery tickets at a location along said dispensing path upstream of said line of weakness;

at least one discharge roller at said bursting station contacting said lottery tickets at a location along said dispensing path downstream of said line of weakness, said discharge and feed rollers each being rotationally driven and cooperating to hold said lottery tickets while said burster separates said pair of adjacent lottery tickets along said line of weakness.

7. A lottery ticket dispenser storing a plurality of lottery tickets connected in a fanfold stream, a pair of adjacent said tickets being separable from each other along a line of weakness therebetween, a transport mechanism having a roller mounted for rotation about a roller axis for feeding said stream of tickets along a dispensing path to an outlet, and a bursting station located along said dispensing path and a rotational burster movably mounted to intersect said dispensing path generally perpendicularly thereto and proximate said line of weakness at said bursting station, said lottery ticket dispenser comprising:

a cylindrical contact surface on said burster which contacts said stream of tickets and separates said pair of adjacent tickets along said line of weakness even if said cylindrical contact surface is offset from said line of weakness upon contact with said stream of tickets, wherein an axis of rotation of said burster is generally perpendicular to said roller axis.

8. The dispenser of claim 7 wherein said cylindrical contact surface on said burster extends completely around a circumference of said burster.

9. A method of separating individual generally planar articles joined together along a line of weakness comprising the steps of:

feeding a plurality of said articles connected together along a path, said feeding being accomplished with at least one feed roller rotating about a roller axis;

moving a burster to intersect the path; and bursting said line of weakness with the burster contacting said articles proximate said line of weakness, said burster having a cylindrical contact surface which contacts said articles and thereby bursts said line of weakness and separates said pair of adjacent articles, said burster being rotated about a burster axis generally perpendicular to said roller axis during said bursting.

10. The method of claim 9 further comprising:

deflecting said articles with said burster in conjunction with said bursting step.

11. The method of claim 9 further comprising:

interrupting said feeding and holding said articles during said bursting with the at least one feed roller located upstream of said line of weakness and at least one discharge roller located downstream of said line of weakness.

12. The method of claim 9 further comprising:

spacing said burster from said line of weakness during said bursting.

13. A method of dispensing lottery tickets comprising the steps of:

feeding a plurality of lottery tickets connected together along a dispensing path, a pair of adjacent said tickets being separable from each other along a line of weakness therebetween, said feeding being accomplished with at least one feed roller rotating about a roller axis;

moving a burster generally perpendicular to the dispensing path;

bursting said line of weakness with the burster contacting said tickets proximate said line of weakness, said burster having a cylindrical contact surface which contacts said tickets and thereby bursts said line of weakness and separates said pair of adjacent tickets, said burster being rotated about a burster axis generally perpendicular to said roller axis during said bursting; and discharging one of said tickets to an outlet.

14. The method of claim 13 further comprising:

deflecting said tickets with said burster prior to said bursting step.

15. The method of claim 13 further comprising:

interrupting said feeding and holding said tickets during said bursting with the at least one feed roller located upstream of said line of weakness and at least one discharge roller located downstream of said line of weakness.

16. The method of claim 13 further comprising:

spacing said burster from said line of weakness during said bursting.

17. A method of dispensing lottery tickets comprising the steps of:

feeding a plurality of lottery tickets connected together along a dispensing path, a pair of adjacent said tickets being separable from each other along a line of weakness therebetween;

intercepting said dispensing path with a burster and contacting said stream of tickets in a direction generally parallel to the line of weakness and spaced from the line of weakness;

bursting said line of weakness with said burster contacting said stream of tickets, said burster having a cylindrical contact surface on a perimeter thereof, said cylindrical contact surface contacts said stream of tickets and thereby bursts said line of weakness and separates said pair of adjacent tickets; and discharging one of said tickets to an outlet.

18. The method of claim 17 further comprising:

interrupting said feeding and holding said stream of tickets during said bursting.

19. A method of dispensing lottery tickets comprising the steps of:

feeding a plurality of lottery tickets connected together along a dispensing path, a pair of adjacent said tickets being separable from each other along a line of weakness therebetween;

intercepting said dispensing path with a burster and contacting said stream of tickets;

bursting said line of weakness with said burster contacting said stream of tickets, said burster having a cylindrical contact surface on a perimeter thereof, said cylindrical contact surface contacts said stream of tickets and thereby bursts said line of weakness and separates said pair of adjacent tickets; and interrupting said feeding and holding said stream of tickets during said bursting.

20. The method of claim 19 further comprising:

spacing said burster from said line of weakness during said bursting.

* * * * *